United States Patent [19]

Schulz

[11] 4,104,738

[45] Aug. 1, 1978

[54] MIXING TOOL

[75] Inventor: Stefan Schulz, Vellmar, Fed. Rep. of Germany

[73] Assignee: Thyssen Industrie Aktiengesellschaft, Essen, Fed. Rep. of Germany

[21] Appl. No.: 709,305

[22] Filed: Jul. 28, 1976

[30] Foreign Application Priority Data

Aug. 1, 1975 [DE] Fed. Rep. of Germany ..... 2534418

[51] Int. Cl.[2] ..... B01F 7/26; B01F 7/32

[52] U.S. Cl. ..... 366/343; 366/315

[58] Field of Search ..... 259/107, 108, 7, 8, 259/23, 24, 43, 44, 6, 66, 67, 121, 122; 416/223 R, 227 R, 242

[56] References Cited

U.S. PATENT DOCUMENTS

| | | | |
|---|---|---|---|
| 2,576,802 | 11/1951 | Morris | 259/108 |
| 3,024,010 | 3/1962 | Sperling | 259/107 |
| 3,250,519 | 5/1966 | Herfeld | 259/107 |
| 3,337,193 | 8/1967 | Berker | 259/107 |
| 4,030,707 | 6/1977 | Moreton | 259/108 |

*Primary Examiner*—Robert W. Jenkins
*Attorney, Agent, or Firm*—Walter Becker

[57] ABSTRACT

A mixing tool for installation in a mixing container and method of making same. The mixing tool has a disc-shaped member with a semi-circular section connected in radially spaced relationship to a rotatable shaft so as to be coaxial therewith and has plane top and bottom surfaces perpendicular to the axis of rotation of the rotatable shaft. The disc-shaped member also has a twisted section merging with each other the top and bottom surfaces of the semi-circular section and likewise arranged and connected to the shaft in spaced relationship thereto. The mixing tool is preferably made from a circular disc with plane top and bottom surfaces, which is cut open by a single radial cut. One of the cut end portions is then twisted and reunited to the other cut end portions whereupon the thus obtained member is arranged in spaced relationship to a rotatable shaft and connected thereto.

1 Claim, 3 Drawing Figures

MIXING TOOL

The present invention relates to a mixer with tool surfaces connected to a hub, for installation at the bottom side in mixers for a pulverous, granular or liquid substance to be mixed, said mixer having an upright cylindrical container in which a conical circulation of the substance to be mixed occurs at circumferential tool speeds up to 50 meters per second of the tool ends extending nearly up to the inner wall of the container.

Heretofore known mixing tools for mixers of the above mentioned general type comprise wing-like arms which extend from the hub up to near the container inner wall. These arms are arranged close to the container bottom and substantially independently of the cross section of the arms cause the substance to be mixed to circulate in a funnel-shaped form at circumferential speeds up to 50 meters per second. The material to be mixed is by the tool arranged close to the container bottom centrifuged outwardly toward the inner wall where it rises in a spiral movement upwardly and drops or flows subsequently back to the center of the container, whereupon it is again by the tool at the bottom side of the container accelerated for a new circulation. Within the ring formed by the material to be mixed and sliding along the container inner wall, the adjacent particles to be mixed respectively have different velocities while, however, there exists the danger that in the annular core region of the ring formed by the material to be mixed, the different speed over the adjacent particles to be mixed becomes very small so that a portion of the particles of the material to be mixed stays there for a longer period of time. In order to avoid such zone of slower movement which has a disadvantageous effect on the quality of material to be mixed, frequently a plurality of tools are employed which are arranged in spaced relationship one above the other and rotate at the same speed. The installation of additional tools, however, greatly increases the costs for the mixer because the cost of material for the stainless tool steels to be employed, as well as the cost for the polishing of the tool surface, are relatively high.

It is, therefore, an object of the present invention to provide a mixing tool for the installation in mixers of the above mentioned general type, by means of which the formation of a slow-moving zone in the annular core region of the ring of material to be mixed with a funnel-shaped circulation of the material to be mixed will be avoided while the costs for the tool will be considerably reduced over tools arranged at a plurality of levels.

These and other objects and advantages of the invention will appear more clearly from the following specification in connection with the accompanying drawings, in which.

Figure 1:
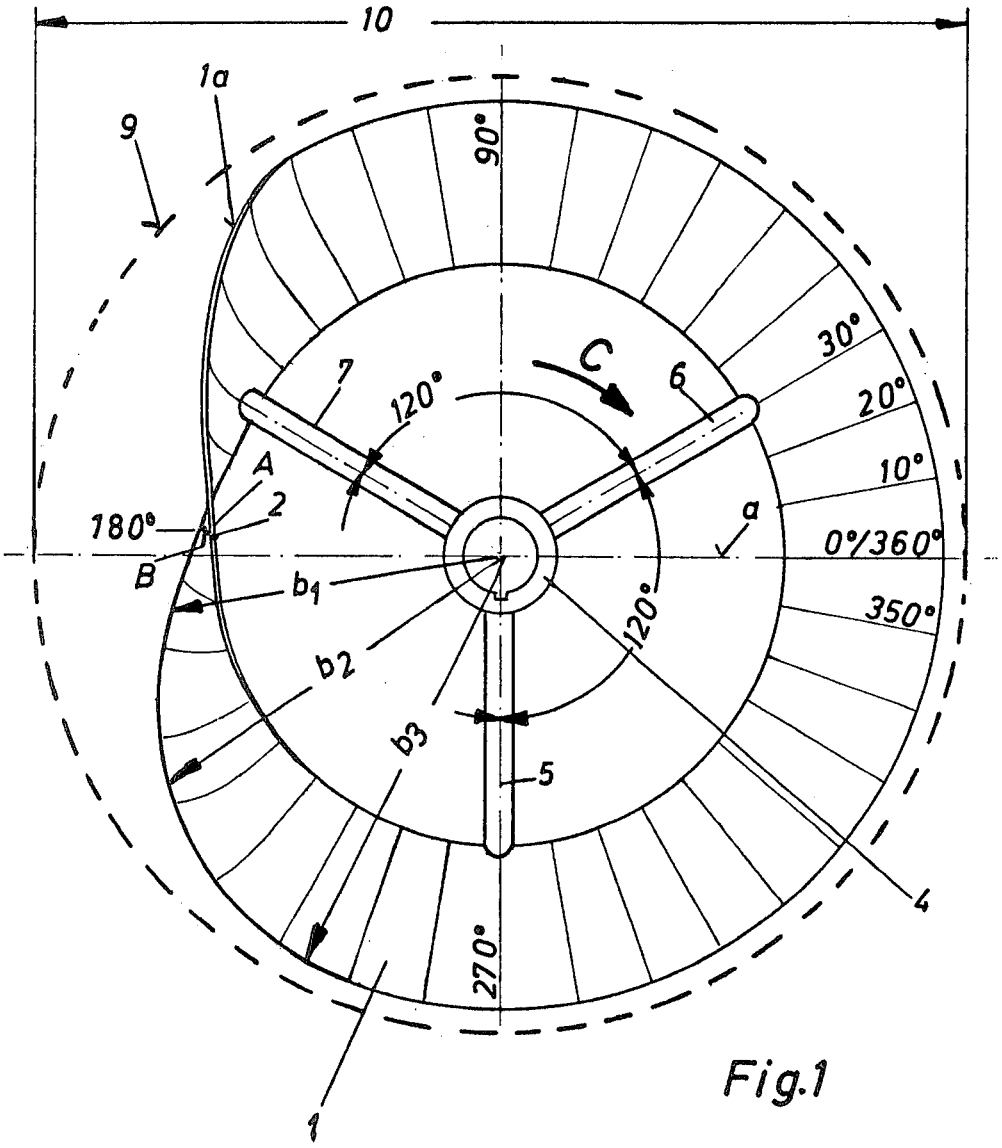
FIG. 1 represents a top view of a mixing tool system.

The mixing tool according to the invention is characterized primarily in that the tool surface is formed of an originally plane circular annulus of a relatively thin wall thickness, the original outer diameter of which is to a slight extent less than the inner diameter of the container, while the original inner diameter of said circular annulus amounts to about from 50 to 70% of the original outer diameter. The circular annulus is separated in radial direction at one area and while arching, said circular annulus is with the separating edges offset by 180°, again put together and by a plurality of arms is connected to the hub located in the center of the originally plane circular annulus while the seam between the separating edges butt together but offset by 180°, extend nearly parallel to the axis of rotation of the tool.

Referring now to the drawings in detail, the plane annulus 1 comprises an outer diameter $D_1$ which is slightly less than the inner diameter 10 of the mixing container 9 for which the mixing tool is intended that is to be prepared from said circular annulus. The inner diameter has a length of about from 50 to 70% of the outer diameter $D_1$. Arranged on said annulus 1 and spaced by 10° over an angle of 360° are graduations the zero and 360° graduations of which are located on the horizontal axis *a*. The graduation is from the 0° location marked by radially extending lines in counterclockwise direction. These graduation lines are not components of the finished mixing tool but are merely intended to explain and clarify the following remarks.

Figure 2:
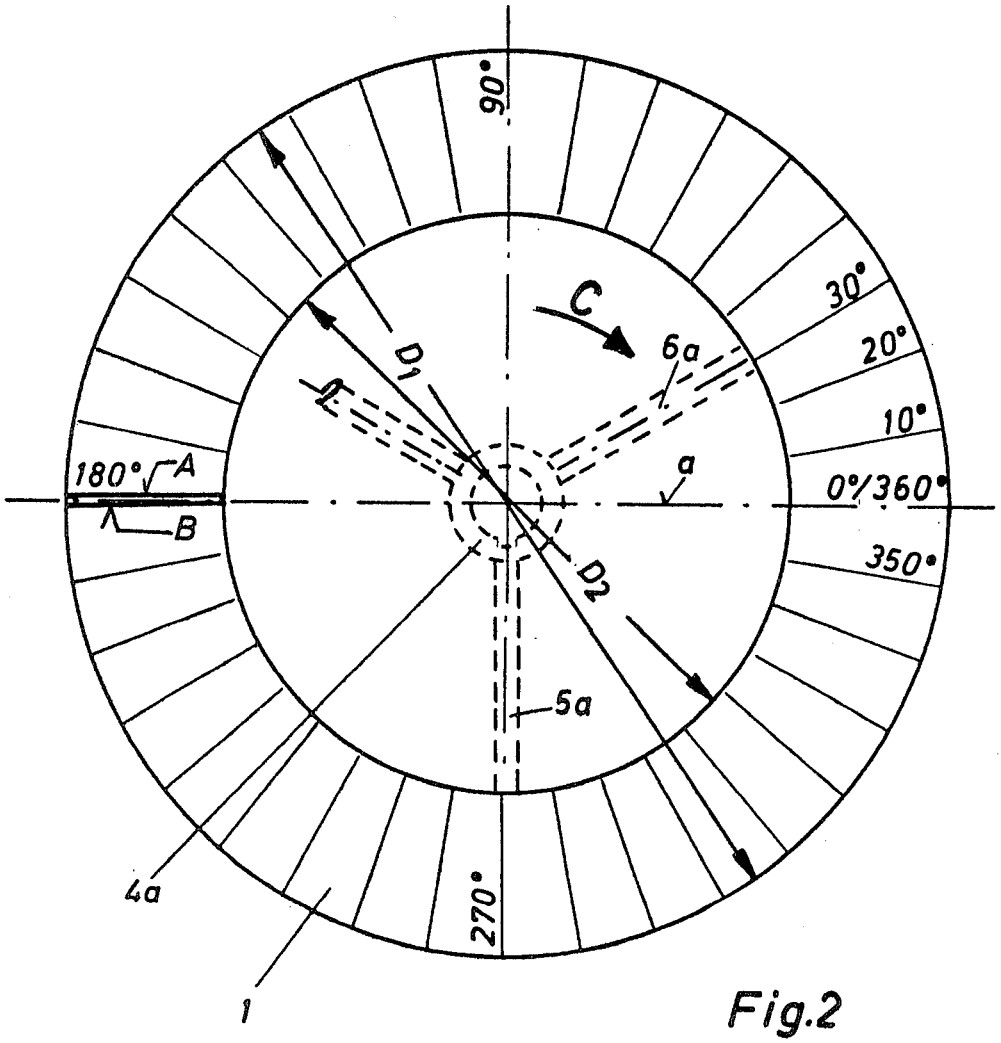
FIG. 2 is a top view of a plane circular annulus prior to its transformation into the form of a mixing tool according to FIG. 1.

According to the embodiment of the invention as illustrated in FIG. 2, the annulus or ring 3 which consists of stainless steel is cut open in radial direction at the 180° area (on the left hand side of FIG. 2) of the 360° graduation. The separating edges located opposite each other are respectively designated with the characters A and B. While simultaneously arching the now open ring 1, the separating edge A which in FIG. 2 is located at the top is turned by 180° and is brought in position so as to cover the separating edge B and is connected thereto for instance by welding. The seam 2 located on the original graduation line at 180° of the 360° graduation between the now offset and again connected separating edges A and B extends substantially parallel to the axis of rotation 3 of the mixing tool 1*a*.

The hub 4 is arranged by means of three arms 5, 6 and 7 respectively offset to each other by 120° and connected to the tool surface arched in itself. The length of the arms 5, 6 arranged in the angular positions of the 360° graduation 5*a* and 6*a* corresponds to the length of the arms which as indicated in FIG. 2 would extend from the original ring 1 to a central hub 4*a*.

Figure 3:
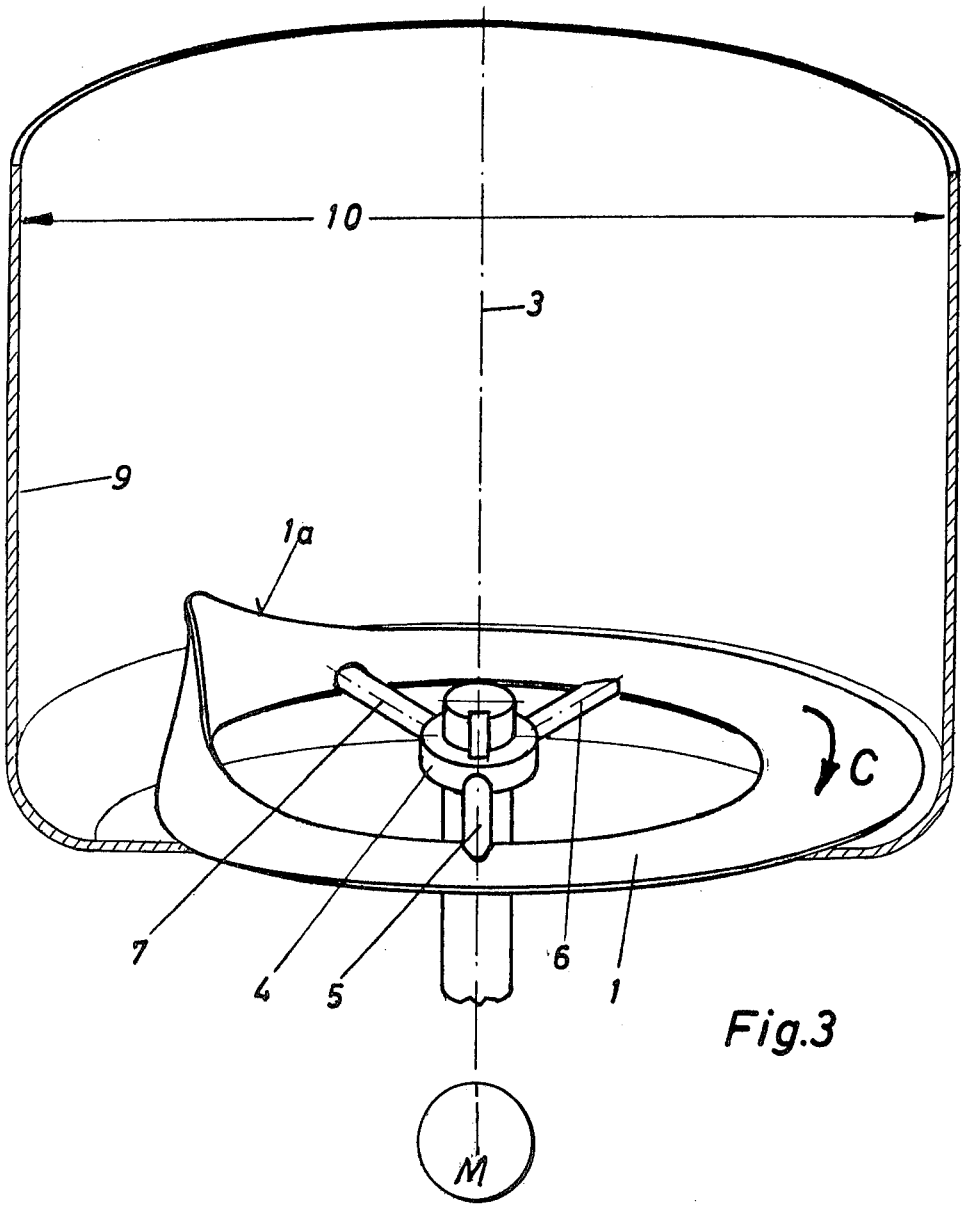
FIG. 3 is a perspective illustration of the tool according to FIG. 1.

FIG. 1 illustrates a top view of the finished arched mixing tool. FIG. 3 illustrates in perspective the mixing tool in its mounted position on the bottom side in the indicated mixing container 9.

The preferred direction of rotation is indicated by the arrows C pointing in clockwise direction.

The above described separation or cutting open of the ring 1 and the described connection of the separating edges A and B in a position offset by 180° results in a single tool surface which is closed in itself and which, depending on the position within the indicated 360° graduation exerts different effects upon the material to be mixed. The major horizontally extending portion within the region of from 270° above 360°/0° to 90° in the manner of any tool or member having a first disc-shaped section throws the material to be mixed radially outwardly. The tool surface portion which is visible from above and which arches upwardly within the region of from 90° to 180° from the horizontal plane into the vertical position intersects with its outer edge 1*a* in the material to be mixed, which means in the bottom side of the circulating ring of material to be mixed and draws said material downwardly and inwardly. The material to be mixed is conveyed primarily upwardly by means of the tool surface portion which is visible from above within the region of 180° to about 270°. By means of the said tool surface portion which from its vertical position again turns into a horizontal position and at the same time has in the area of from 180° to 270° increasing distances $b_1$, $b_2$, $b_3$ from hub 4, the material to be mixed is conveyed primarily in upward direction. The non-symmetric configuration with regard to the vertical axis of rotation 3 of the mixing tool will at circumferential velocities of the tool up to 50 meters per second bring about a very pronounced funnel-shaped circulation of the material to be mixed. In this connection, by means of the arched portions of the tool surfaces, additional upwardly and downwardly directed pulses are in fast sequence imparted upon the particles of the mixture. These pulses bring about an additional intermixing of the circulating ring of mixing material in vertical direction.

The advantage obtained by the mixer according to the present invention consists in that a formation of a dead center zone in the annular core region of the ring of mixing material circulating in the mixing container is avoided by the specific design of the one-surface mixing tool.

It is, of course, to be understood that the present invention is, by no means, limited to the specific showing in the drawings, but also comprises any modifications within the scope of the appended claims.

What I claim is:

1. A rotatable mixing tool for installation in a mixing container, which includes: a rotatable shaft, having an axis of rotation, a member surrounding said shaft in radially spaced relationship thereto and being connected to said shaft for rotation therewith, said member having a first disc-shaped section coaxial with the axis of rotation of said shaft and having a top and a bottom surface located in planes perpendicular to said axis of rotation of said rotatable shaft, said member also having a second section twisted relative to said first section so as to merge said top surface of said first section with the bottom surface of the latter.

* * * * *